US006604491B2

(12) United States Patent
Davis

(10) Patent No.: US 6,604,491 B2
(45) Date of Patent: Aug. 12, 2003

(54) BOILER APPARATUS

(76) Inventor: David Davis, 120 Braley Rd., East Freetown, MA (US) 02717

( * ) Notice: Subject to any disclaimer, the term of this patent is extended or adjusted under 35 U.S.C. 154(b) by 0 days.

(21) Appl. No.: 10/059,719

(22) Filed: Jan. 29, 2002

(65) Prior Publication Data

US 2002/0170501 A1 Nov. 21, 2002

Related U.S. Application Data

(60) Provisional application No. 60/265,098, filed on Jan. 30, 2001.

(51) Int. Cl.[7] ..... F22D 5/26

(52) U.S. Cl. ..... 122/14.22; 122/247; 122/451.1

(58) Field of Search ..... 122/13.01, 14.2, 122/14.22, 18.1, 247, 249, 447, 449, 451.1

(56) References Cited

U.S. PATENT DOCUMENTS 4,550,689 A * 11/1985 Wolter ..... 122/14.21
5,636,598 A * 6/1997 Moore, Jr. ..... 110/162
5,687,678 A * 11/1997 Suchomel et al. ..... 122/247
6,152,086 A * 11/2000 Brouwer et al. ..... 122/249

* cited by examiner

*Primary Examiner*—Gregory Wilson
(74) *Attorney, Agent, or Firm*—Damon J. Borrelli

(57) ABSTRACT

Disclosed is a boiler apparatus useful for the heating of living and working spaces. The disclosed boiler apparatus incorporates a burner element and controller element that cooperate to provide a modulated firing rate. The modulated firing rate serves to increase the efficiency of the disclosed boiler apparatus. The boiler apparatus of the invention incorporates a heat exchanger and a combustion system. In operation, the control element collects and analyzes information from a multiplicity of sensors in order to modulate the firing rate of the burner element so as to maintain a selected output temperature for the water being heated. This monitoring activity by the control element also avoids short cycling of the boiler apparatus of the invention. The boiler apparatus of the invention also includes an indicator light that provides a visual indication the invention's operational status.

1 Claim, 2 Drawing Sheets

BOILER APPARATUS

CROSS-REFERENCE TO EARLIER FILED PROVISIONAL APPLICATION

This application is a continuation of a provisional application having Application No. 60/265,098 entitled BOILER APPARATUS of inventor David Davis filed Jan. 30, 2001.

BACKGROUND OF THE INVENTION

1. Field of the Invention

The present invention relates to boiler apparatuses. More particularly, it relates to a high efficiency, compact boiler apparatuses.

2. Description of the Prior Art

The heating of living and working spaces is of vital importance in connection with both residential and commercial construction. In particular, efficient and safe heating of living and working spaces is necessary for a wide variety of economic and quality of life reasons.

Heating systems utilizing heated water provide heat by continuously circulating heated water through a loop of piping. In operation, relatively cold water enters a boiler apparatus where it is heated using, for example, the combustion of oil or gas. The heated water is then circulated through pipes to radiator assemblies where the heat present in the water is radiated out into the surrounding area. The then cooled water circulates back to the boiler apparatus where it is re-heated and then re-circulated through the system. Given the high cost of oil and gas, high efficiency boilers have become increasingly necessary as a means for increasing the overall efficiency of available heating systems.

Currently available high efficiency boilers suffer from several limitations. For example, these boilers often are large in size and, as a result, require significant space for their installation. Still further, local fire department ordinances may limit the positioning of these boilers to areas distant from the living and working areas to be heated. Finally, the inability of currently available boilers to modulate their burner's firing rate in response to, for example, changing heating requirements can further decrease these boiler's operational efficiency.

A need exists for a boiler apparatus that is simple in design and does not suffer from the limitations of prior art devices.

SUMMARY OF THE INVENTION

It is an object of the present invention to provide a boiler apparatus that does not suffer from the foregoing disadvantages and limitations.

It is another object of the present invention to provide a boiler apparatus that is simple in construction and compact in design.

It is yet another object of the present invention to provide a boiler apparatus that is easy to install and maintain.

It is yet another object of the present invention to provide a boiler apparatus that is easily and economically produced, and readily assembled.

Other general and specific objects of the invention will in part be obvious and will in part appear hereinafter.

The boiler of the invention is generally characterized by a heat exchanger element, a burner element, and a controller element.

The heat exchanger element typically includes a coiled tubing element that functions to direct the water passing through the boiler apparatus of the invention.

The burner element includes an ignition element that provides a spark to ignite the combustible material, for example, natural gas, being used in connection with burner apparatus of the invention. The burner element also typically includes a gas valve and a venturi system. The burner element is configured to create a regulated combustion mixture of fuel and air that functions to maximize the overall efficiency of the boiler apparatus of the invention.

The controller element receives information regarding the operational status of both the boiler apparatus of the invention and the heating system into which it is incorporated. Typically, the controller element receives information from temperature sensors that monitor the temperature of the incoming and exiting water supplies within the boiler apparatus of the invention and thermostats in the living or working area to be heated. The controller element utilizes an algorithm that translates the thermal information received from the sensors and into operational activity by the boiler apparatus of the invention.

The boiler apparatus of the invention also includes a blower motor connected to a burner fan. The motor, and thus fan, pre-purges the boiler apparatus of the invention both before and after ignition of the burner element of the boiler apparatus of the invention.

Finally, the boiler apparatus of the invention typically includes an operation indication light that provides a visual indicator of the operational status of the boiler apparatus of the invention.

The invention also contemplates a method of operation for the boiler apparatus of the invention. To commence the method of the invention, a thermostat sensor calls for heat causing pump element to start. Concurrent with this action, and continuously, the controller element monitors the return temperature of that water entering the boiler apparatus of the invention via a sensor. When the controller element senses a drop in the return water temperature below a temperature set point minus a differential set point, the controller element causes the burner element to ignite after performing a first pre-purge cycle. Once ignited, the burner element burns the combustible material being supplied to the boiler apparatus of the invention. This action results in the boiler apparatus of the invention starting to heat that water passing through the heat exchanger element. To complete the method of the invention, when the thermostat sensor senses a pre-set temperature in the space being heated, the boiler apparatus of the invention proceeds through a second pre-purge cycle before shutting off.

The invention accordingly comprises the steps and apparatus embodying features of construction, combinations of elements and arrangements of parts adapted to affect such steps, as exemplified in the following detailed disclosure.

BRIEF DESCRIPTION OF THE DRAWINGS

A fuller understanding of the nature and objects of the present invention will become apparent upon consideration of the following detailed description taken in connection with the accompanying drawings in which.

DETAILED DESCRIPTION OF THE PREFERRED EMBODIMENTS

Figure 1:
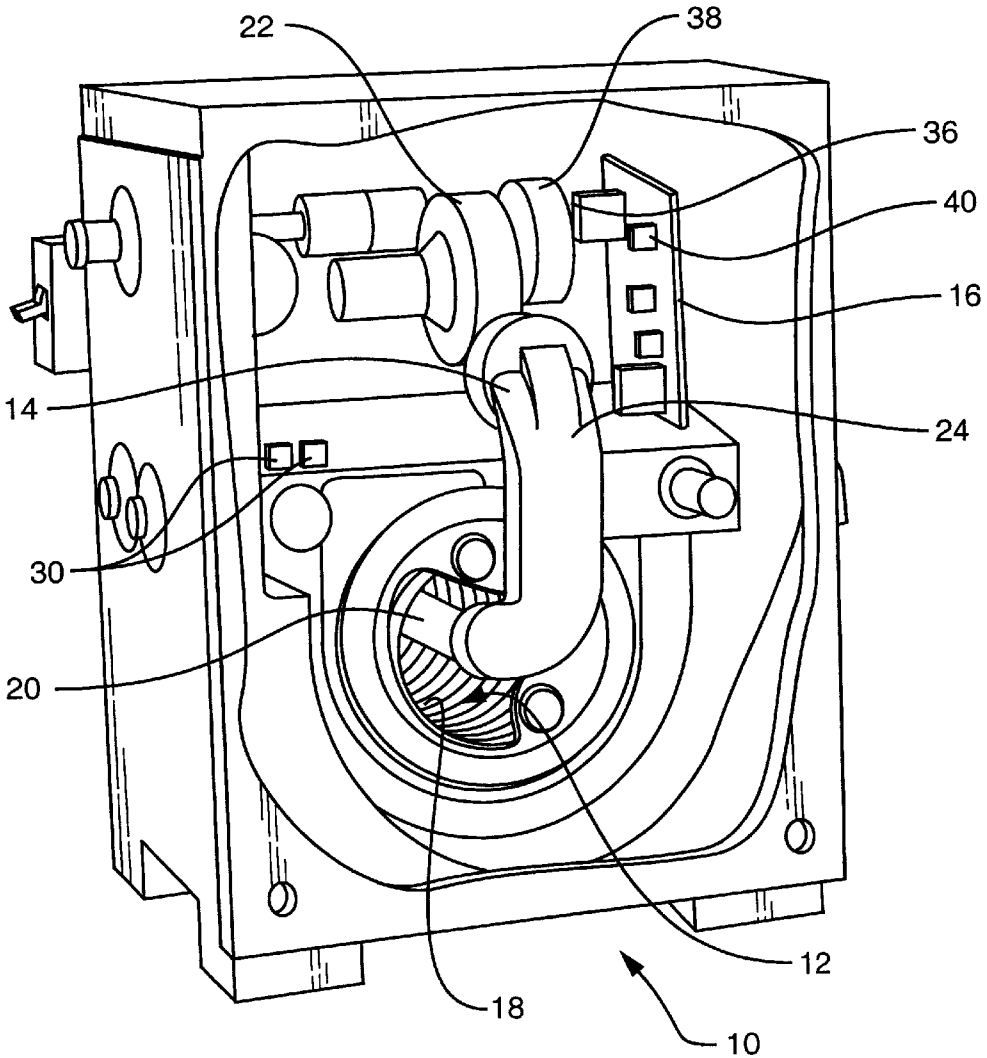
FIG. 1 is a cut away view of a boiler apparatus in accordance with the invention.
Figure 2:
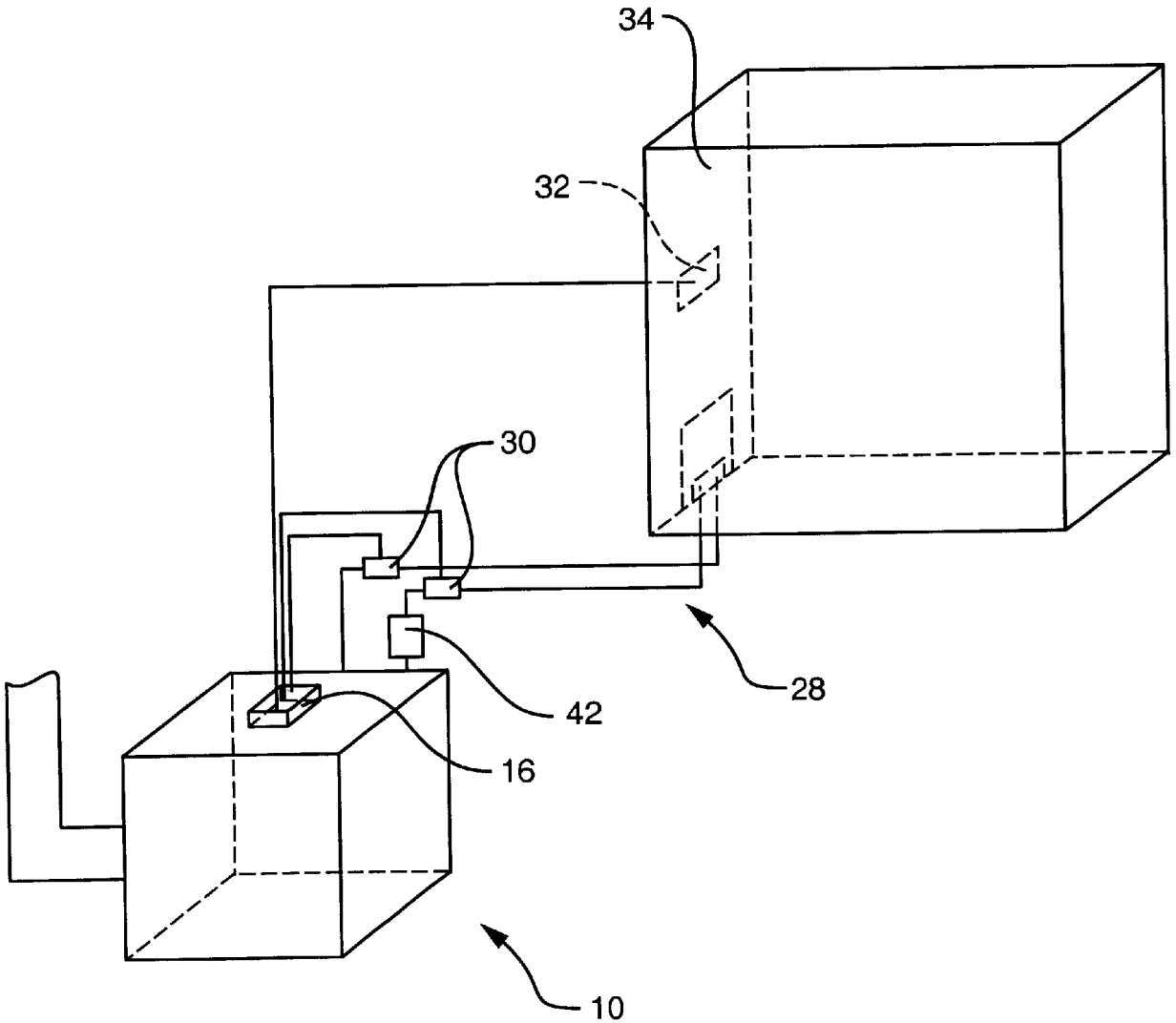
FIG. 2 is a schematic view of a boiler apparatus in accordance with the invention positioned for operation within a heating system.

Referring now to FIGS. 1 and 2, there is shown a boiler apparatus of the invention 10. The boiler apparatus of the invention 10 includes a heat exchanger element 12, a burner element 14, and a controller element 16. The controller element 16 modulates the operation of the burner element 14 in response to a variety of thermal conditions as noted below.

The heat exchanger element 12 typically includes a coiled tubing element 18 that functions to direct the water passing through the boiler apparatus of the invention 10 around the flame created by the burner element 14. The heat exchanger element 12 is preferably manufactured from stainless steel.

The burner element 14 includes an ignition element 20 that provides a spark to ignite the combustible material, for example, natural gas, being used in connection with burner apparatus of the invention 10. In the preferred embodiment of the invention, the burner element 14 includes a gas valve 22, manufactured by Honeywell Systems, Inc., and a venturi system 24. The burner element 14 is configured to create a regulated combustion mixture of fuel and air that functions to maximize the overall efficiency of the boiler apparatus of the invention 10.

The controller element 16 receives information regarding the operational status of both the boiler apparatus of the invention 10 and the heating system 28. For example, the controller element 16 receives information from temperature sensors 30 that monitor the temperature of the incoming and exiting water supplies within the boiler apparatus of the invention 10. In addition, thermostats 32 in the living or working area to be heated 34 provide temperature information to the controller element 16.

The controller element 16 utilizes an algorithm that translates the thermal information received from the sensors 30 and 32 into operational activity by the boiler apparatus of the invention 10. More particularly, the controller element 16 compares the incoming water temperature as monitored by the sensor 30 against a pre-set temperature and a differential temperature. When the sensor 30 senses a temperature change for the incoming water that is in excess of the difference between these values, the controller element 16 starts the burner element 14 and commences to actively heat that water passing through the heat exchanger element 12. Heating of the water by the boiler apparatus of the invention 10 continues until the sensor 32 provides information that the desired temperature has been achieved within the living or working area being heated 34.

The boiler apparatus of the invention 10 also includes a blower motor 36 connected to a burner fan 38. Actuation of the motor 36, and thus fan 38, at the commencement of a heating cycle pre-purges the boiler apparatus of the invention 10 before ignition of the burner element 14 of the boiler apparatus of the invention 10. Actuation of the motor 36, and thus fan 38, at the end of a heating cycle also pre-purges the boiler apparatus of the invention 10 after the burner element 14 has been shut-off by the controller element 16. The motor 36, and thus fan 38, typically are of a low voltage direct current configuration with a pulse relay counting. This type of motor 36 and fan 38 combination is preferred as it permits precise control over the speed of the fan 38. Further, this type of fan 38 also permits precise control over the combustion air volumes by the controller element 16.

Finally, the boiler apparatus of the invention 10 typically includes an operation indication light 40. The light 40 provides a visual indicator of the operational status of the boiler apparatus of the invention 10. More particularly, the light 40 pulses constantly during normal operation of the boiler apparatus of the invention 10. When a problem occurs in connection with the boiler apparatus of the invention 10, the light 40 blinks slowly.

In operation, when the thermostat sensor 32 calls for heat, the boiler apparatus of the invention 10 will start the pump element 42 and start to monitor the return temperature of that water entering the boiler apparatus of the invention 10 via the sensor 30. These actions are undertaken before the burner element 14 begins to heat that water contained within the heat exchanger element 12. When the controller element 16 senses a drop in the return water temperature below the temperature set point minus the differential set point, the controller element 16 commences a burning cycle during which the burner element 14 will ignite and, thus, commence the combustion of the gas. By monitoring the temperatures noted above, and initiating an ignition cycle only after certain parameters are satisfied, the boiler apparatus of the invention 10 the controller element 16 eliminates ignition of the burner element 14 every time the thermostat sensor 32 calls for heat. This feature, thus, prevents the boiler apparatus of the invention 10 from short cycling.

Once the controller element 16 has sensed the temperature difference noted above, but before ignition of the combustible material, the boiler apparatus of the invention 10 will activate the blower motor 36, and thus fan 38, for between about two (2) and about ten (10) seconds to pre-purge the boiler apparatus of the invention 10. The controller element 16 will then commence to modulate the burner 22 based upon an analysis of the information provided by the sensor 30. This information can include, in the preferred embodiment of the invention, the return temperature of the water that will pass through the heat exchanger element 12, the supply water temperature, and the set point temperature. By compiling this information, and applying an algorithm thereto, the controller element 16 is able to continuously adjust the firing rate of the burner element 14 while maintaining the desired output temperature.

Heating of the water passing through the heat exchanger element 12 continues as required in order to heat the living and working space 34 via the heating system 28.

When the thermostat sensor 32 senses a pre-set temperature in the space being heated 34, the boiler apparatus of the invention 10 proceeds through a second pre-purge cycle before shutting off. During this later cycle, the motor 36, and thus fan 38, is again activated for a selected period of between about two (2) and about ten (10) seconds.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

What is claimed is:

1. A boiler for heating a supply of water, said boiler comprised of a heat exchanger means, a burner means, and a controller means, said heat exchanger means being in close proximity to said burner means, said heat exchanger means including a coiled tubing element having a first end and a second end, said coiled tubing element defining a cylindrical enclosure, said burner means including an ignition means for providing an ignition spark, a gas valve means and a venturi means, said gas valve means being in fluidic communication with said venturi means, said burner means being positioned within said cylindrical enclosure defined by said coiled tubing element, said controller means being configured to receive information regarding the operational status of said heat exchanger means and said burner means, said controller means being comprised of a first sensor means affixed to said first end of said heat exchanger means for monitoring the temperature of said water entering said boiler, said first sensor means including a communication means for transmitting said temperature information regarding said water entering the boiler to said controller means, a second sensor means affixed to said second end of said heat exchanger means for monitoring the temperature of said water exiting said boiler, said second sensor means including a communication means for transmitting said temperature information regarding said water exiting the boiler to said controller means, said controller means including a means for receiving said temperature information from said first sensor means and said second sensor means, said controller means utilizing said temperature information received from said first sensor means an said second sensor means to regulate the operation of said burner means.

* * * * *